US005375276A

United States Patent [19]

Nelson et al.

[11] Patent Number: 5,375,276

[45] Date of Patent: Dec. 27, 1994

[54] PORTABLE SURGICAL TABLE

[75] Inventors: James H. Nelson, Middletown; Leo W. Jenkins, Thurmont; Mark W. Brown, Myersville, all of Md.

[73] Assignee: The United States of America as represented by the Secretary of the Army, Washington, D.C.

[21] Appl. No.: 17,199

[22] Filed: Feb. 5, 1993

[51] Int. Cl.[5] ..... A61G 13/00

[52] U.S. Cl. ..... 5/620; 5/621; 5/623; 5/503.1; 5/507.1

[58] Field of Search ..... 5/9.1, 600, 620, 621, 5/623, 625, 626, 503.1, 507.1, 905; 182/119, 181; 211/187, 190

[56] References Cited

U.S. PATENT DOCUMENTS

| | | | |
|---|---|---|---|
| 2,022,714 | 12/1935 | Gallup | 5/620 |
| 2,276,998 | 3/1942 | Stollenwerk | 5/9.1 |
| 3,046,072 | 7/1962 | Douglass, Jr. et al. | 5/623 X |
| 3,358,300 | 12/1967 | Smith | 5/625 X |
| 4,042,232 | 8/1977 | Lile et al. | 5/621 X |
| 4,457,502 | 7/1984 | Beach | 5/600 X |

FOREIGN PATENT DOCUMENTS

| | | | |
|---|---|---|---|
| 477801 | 5/1975 | Australia | 5/626 |
| 967514 | 5/1975 | Canada | 5/600 |
| 1009579 | 11/1965 | United Kingdom | 5/625 |

*Primary Examiner*—Michael F. Trettel

*Attorney, Agent, or Firm*—Werten F. W. Bellamy; John Francis Moran

[57] ABSTRACT

The present invention relates to a surgical table capable of supporting a military litter. The table, comprising a base and at least one cross member, is made of lightweight, durable material, is portable, and is relatively easy to assemble, disassemble, and package for transport. The cross member may be positioned such that the patient's head or feet are elevated or lowered relative to the table's base. The fabric of the litter is used as the direct support for the patient while the patient receives medical attention.

24 Claims, 11 Drawing Sheets

152
130
138
132
126
100
134
104
112
121
126
130
121
112
106
112
110
116
108
112

PORTABLE SURGICAL TABLE

RIGHTS OF THE U.S. GOVERNMENT

The U.S. Government has a non-exclusive, nontransferable, irrevocable, paid-up license to practice or have practiced this invention for or on its behalf.

FIELD OF THE INVENTION

This invention relates to portable surgical tables; in particular, the invention involves surgical tables capable of supporting an occupied military litter where medical personnel may perform medical procedures and operations while a patient rests in a desirable position.

BACKGROUND OF THE INVENTION

All publications or patents mentioned in this specification are herein incorporated by reference.

There are a number of occasions when a patient needs to receive medical attention or when medical personnel need to perform medical procedures outside of the contemporary hospital setting. In some situations, for instance, in emergency situations or during military operations, it is necessary to construct emergency medical and surgical facilities in shod periods of time, on many occasions, in remote locations. Under these circumstances, it is helpful to have equipment which is portable, lightweight, low-volume (to allow for easy transport, durable and easy to assemble and disassemble. The equipment must also meet the needs and demands of the situation and the environment.

A clear example of the need for such equipment is demonstrated by the demands placed on equipment used during far-forward military operations. When the military personnel engage in battle and injuries occur, the proximity of the medical personnel and facilities to the battlefield becomes critical. These operations therefore require personnel and equipment that can be moved quickly, often to remote areas. Because of the terrain, the environment, or the circumstances, it is often necessary to airdrop medical personnel and equipment in the proximity of the far-forward military activities. The medical personnel, for example, the Advanced Trauma Life Support (ATLS) teams and the Advanced Cardiac Life Support (ACLS) teams, require facilities and equipment necessary to hold patients, to perform surgeries, and to provide combat casualty care.

One piece of the equipment used by the medical personnel is the surgical table. Such a surgical table, one usable in far-forward operations, must be lightweight, portable and durable enough to withstand the impact of an air drop. Because far-forward military medical facilities must be ready to accept patients in a limited amount of time, the surgical table must also be quick and easy to assemble and involve as few components as possible. Fewer components typically results in a corresponding reduction in the volume of material to be transported. The assembler would obviously benefit if the components of the tables were also interchangeable with each other. For example, if the legs of one table could be used on any other, the assembler could stockpile components and readily replace those which were missing or damaged.

The ability to use the surgical table in conjunction with a military litter would allow the medical personnel to operate on a patient without having to move the patient from the litter unnecessarily before or during the operation. Limiting the movement of a patient on and off of the litter, in many instances, reduces the pain inflicted on the patient and minimizes the chance of additional injuries. Also, by using the litter as the primary support, the pressure on the patient's shoulders, calves and ankles could be reduced as the patient's weight is distributed across and supported by the litter fabric instead of a flat table surface or a frame, the table should provide the medical teams with the capability of raising the patient's head and feet as necessary. It is also preferable to have the option of operating from either side of the table and beneficial for the table to have means of housing additional medical equipment and accessories.

Existing surgical tables are not easily adapted to address the needs mentioned above, e.g., meeting the demands of far-forward military medical operations or in other emergency situations where medical care must be administered in remote locations and, possibly, under harsh conditions. For instance, U.S. Pat. Nos. 4,865,303; 4,761,000; 4,503,844; 4,474,364; and 4,073,240 disclose transportable surgical tables, however, all of these tables are complicated and time consuming to construct. The tables also appear heavy and difficult to package and transport. None of the tables appears well suited for use in varying environments, e.g. harsh climates, and their durability is questionable. Moreover, all of the tables support the patient using hard flat surfaces which place pressure on the patient's shoulders, calves and ankles. It is expected that the medical personnel would remove the patient from a litter and place him or her on the table before medical assistance could proceed.

U.S. Pat. Nos. 4,718,653; 4,635,913; and 4,811,937 disclose folding surgical drainage platforms. These devices could possibly be used as accessories to a surgical table, but are not designed to support patients during medical operations.

Given the limitations in their available equipment, the medical teams have at times resorted to performing medical procedures while the patient was lying on a military litter supported on a makeshift structure. In some instances, they have used boxes, containers and other equipment to raise the litter to a more desirable height above the floor or ground. The military litters and the makeshift stands presently used, in combination, as operating tables and for other medical activities are, however, totally unsuitable solutions. The work surfaces are not sturdy. Other necessary medical equipment may be placed in the vicinity of the litter but are typically detached from the makeshift operating table's structure. The separation of the work surface from the vital medical accessory equipment such as, for example, monitors and IV stands, increases the risk that the accessory equipment may move separately from the operating work surface as a result of undesired forces. For instance, a person bumping into an IV stand during a bombing attack or an earthquake may knock the stand over or move it in a way which may lead to dangerous consequences.

OBJECTS OF THE INVENTION

It is therefore an object of the present invention to provide a portable, lightweight, low-volume surgical table which is durable, sturdy, and easy to assemble, disassemble, and package.

It is also an object of the present invention to provide a surgical table capable of accommodating a military litter and providing means for supporting the litter during medical operations and procedures.

It is a further object of the present invention to provide a surgical table which does not require the patient's removal from the litter before the patient may receive medical attention.

Another object of the present invention is to provide a surgical table which is usable in all types of environments.

An additional object of the present invention is to provide a surgical table wherein the occupied military litter, placed on the table, supports the patient.

Still another object of the present invention is to provide a surgical table which can be adjusted to raise and lower the position of the patient's head or feet.

A further object of the present invention is to provide a surgical table with interchangeable parts.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel pads, constructions, arrangements, combinations, and improvements herein shown and described.

BRIEF SUMMARY OF THE INVENTION

With the above background and objects in mind, the present invention, in general, contemplates a lightweight, portable, sturdy, and durable surgical table capable of accommodating an occupied military litter. In one preferred embodiment of the present invention, the table includes a base and a cross member attached to one end of the base. The base is typically positioned on the floor or some other surface. Before or after an occupied litter is placed on the cross member, the cross member may be raised or lowered accordingly to position the patient's head or feet in differing locations relative to each other. In situations where the underlying surface is not flat, but it is desired to have the patient lie parallel to ground level, the cross member may be adjusted accordingly. The base and cross member may be made of a lightweight and durable material, e.g. aluminum.

In another embodiment of the present invention, two cross members are attached to the opposing ends of the base. The height of each cross member, in relation to the base and each other, dictate the position and angle of the military litter. For instance, if the cross members supporting the litter are in the same plane parallel to ground level, the patient will rest substantially horizontal. If either cross member is moved such that the cross members are in a plane at an angle to ground level, the patient will rest at an angle to ground level, with either his or her head or feet in an elevated position.

In another embodiment of the present invention, a patient does not have to be moved from the litter to receive medical assistance or for medical personnel to perform medical procedures. The fabric of the litter, which tends to conform to the shape of the patient, is the direct means of supporting the patient. Supporting the patient in this manner reduces the pressure on the patients shoulders, calves, and ankles.

Medical accessories may be attached to or housed on the surgical table. The accessories may include, for example. IV poles, halogen lamps, mounted arm boards, trash bag holders, trays for anesthesia equipment/ventilator/patient monitors and/or life support equipment, mounted instrument trays or any combination of these or other items.

It will be appreciated by those skilled in the art that the foregoing brief description and the following detailed description are exemplary and explanatory of the invention, but are not intended to be restrictive thereof or limiting of the advantages which can be achieved by the invention. Thus, the accompanying drawings, referred to herein and constituting a part hereof, illustrate preferred embodiments of the invention and, together with the detailed description, serve to explain the principles of the invention.

BRIEF DESCRIPTION OF THE DRAWINGS

The present invention, summarized above, is described below in association with the accompanying drawings. These illustrations represent the presently preferred embodiment of the present invention and the best mode contemplated for carrying the invention into effect. It should be understood, however, that the invention is not limited to the precise arrangement and instrumentalities shown.

DETAILED DESCRIPTION OF THE PREFERRED EMBODIMENT

Figure 1:
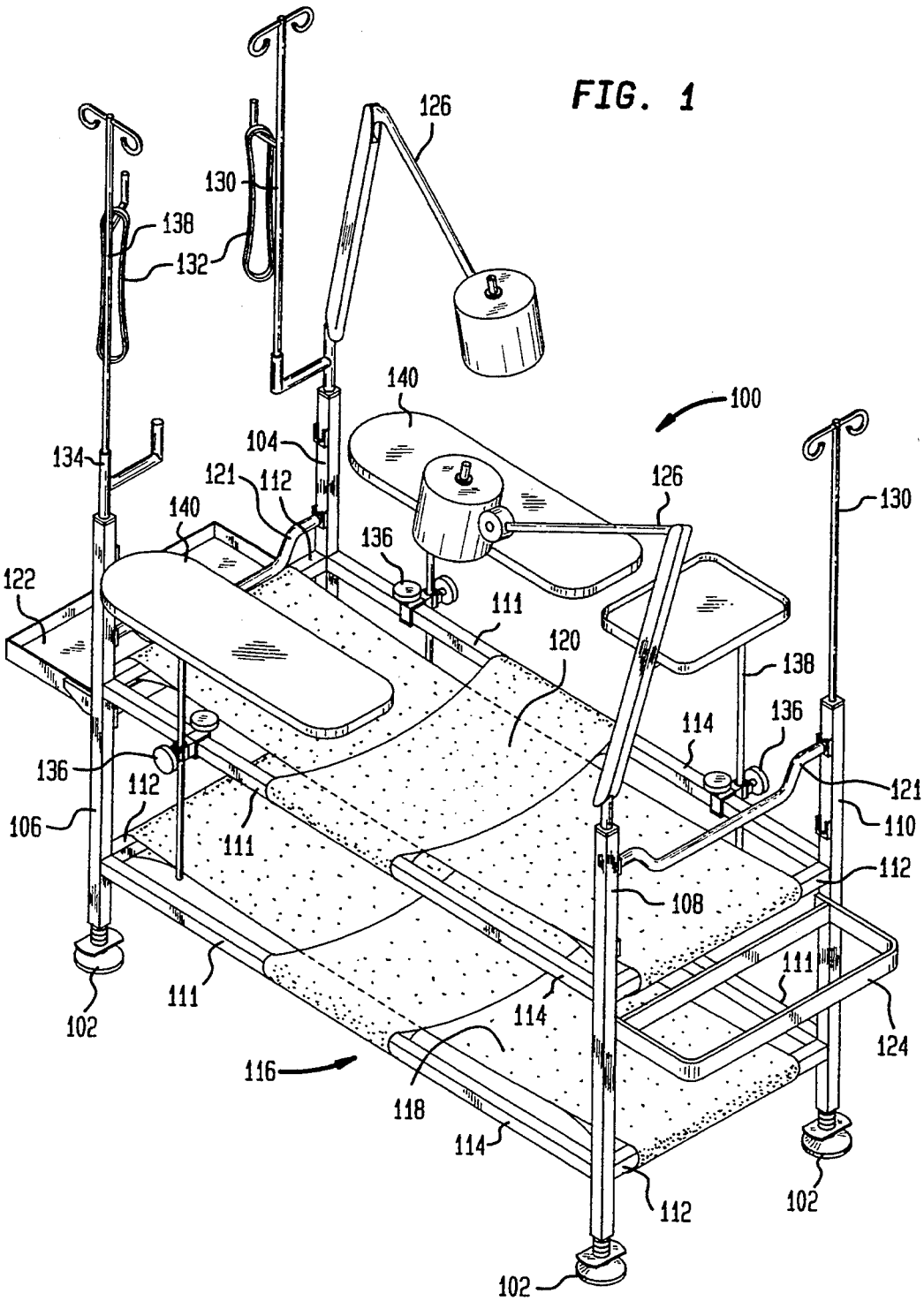
FIG. 1 is a perspective view of an embodiment of the present invention.
Figure 2:
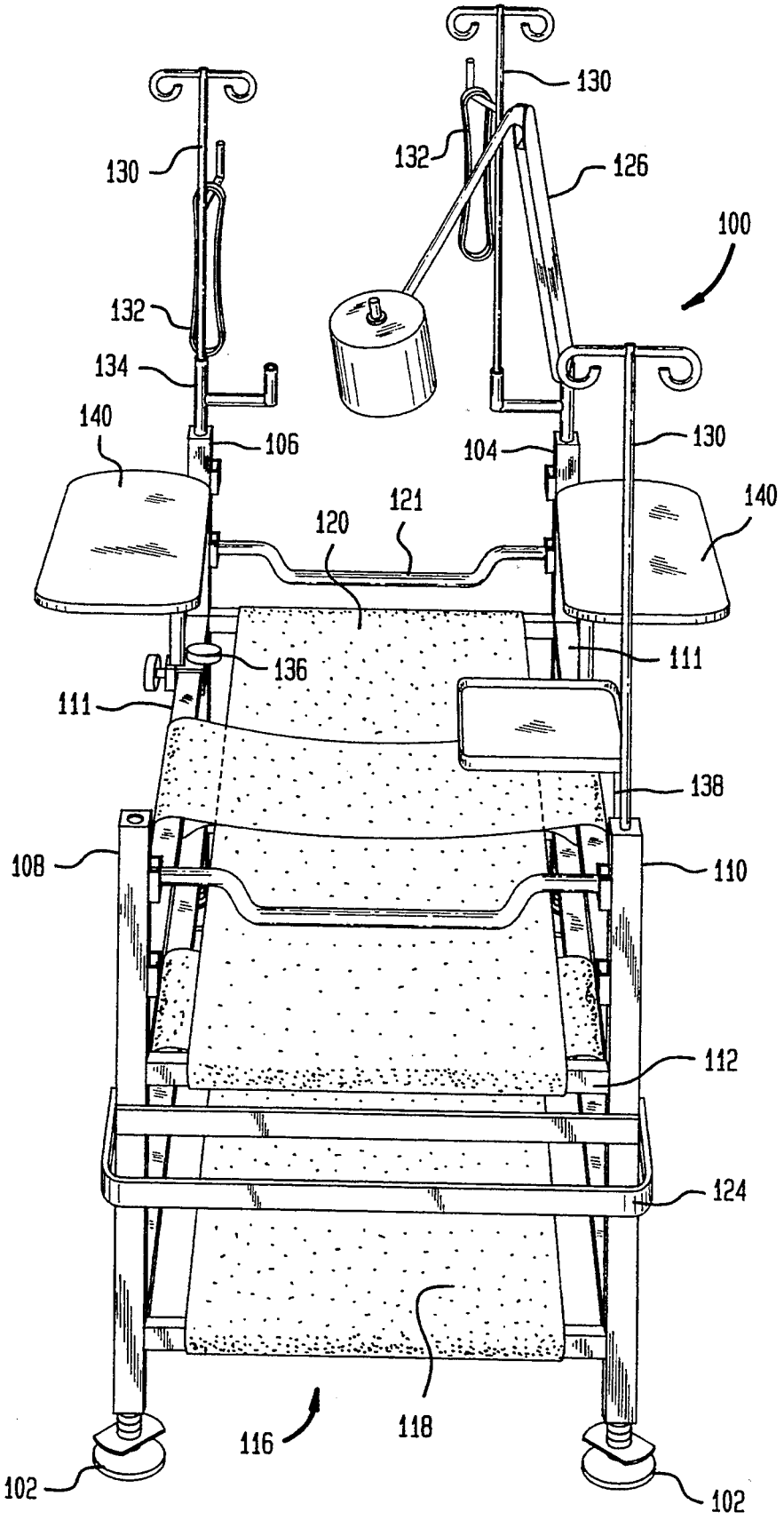
FIG. 2 is an end perspective view of the embodiment of the present invention as seen in FIG. 1.
Figure 3:
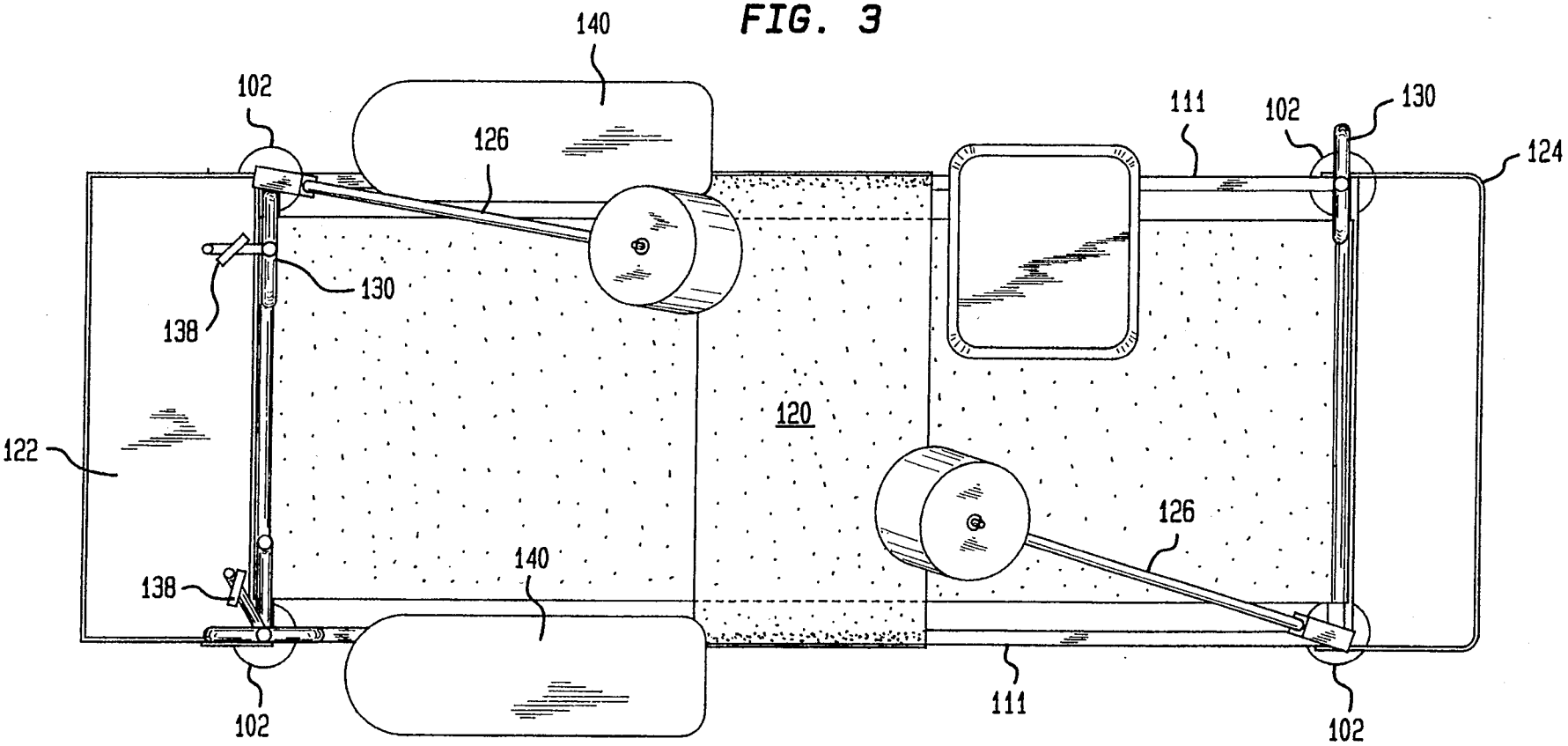
FIG. 3 is a top plan view of the embodiment of the present invention as seen in FIG. 1.

One embodiment of the present invention is shown in FIGS. 1–3. In this embodiment of the present invention, surgical table 100 includes foot pads 102 located at the bottom end of left corner members 104, 108 and right corner members 106, 110. Support members 112 connect left corner member 104 to right corner member 106 and connect left corner member 108 to right corner member 110. Side members 111, the combination of support member 112 and extensions 114 (shown more clearly in FIG. 4), are used to connect left corner member 104 to right corner member 110 and to connect left corner member 108 to right corner member 106 In this embodiment, left corner members 104, 108, right corner member 106.110, support members 112, and extensions 114, in conjunction, form base 116.

Stretched between left corner members 104, 108, right members 106, 11 0, support members 112, and side members 111 are lower shelf 118 and upper shelf 120. On the outer side of and connected to left corner member 104 and right corner member 106 is tray assembly 122. At the other end of base 116, on the outer side of and connected to left corner member 108 and right corner member 110, is bag frame 124.

Affixed to the side members 111 are clamp assemblies 136. Extending upward from clamp assemblies 136 between left corner member 108 and right corner 106 are tray stand assembly 138 and first arm assembly 140. Second arm assembly 140 extends upward from clamp assembly 136 positioned between left corner member 104 and right corner member 110.

Near the top ends of and connected to left corner member 104 and right corner member 106 is a first cross member 121. A second cross member 121 is shown near the top ends of and connected to left corner member 108 and right corner member 110. Extending upward from and connected to the top end of left corner member 108 is first lamp assembly 126. Extending upward from and connected to the top of right corner member 110 is first IV pole 130. Extending upward from and connected to the top ends of left corner member 104 and right corner member 108 are support posts 134. On left corner member 104, extending upward from and connected to support post 134, is second IV pole 130, which has strap 132 hanging therefrom. On right corner member 108, extending upward from and connected to support post 134, are third IV pole 130 and second lamp assembly 126.

Table 100 would generally weigh no more than 85 lbs. and its dimensions would typically be on the order of 53 inches long and 27 inches wide.

Figure 4:
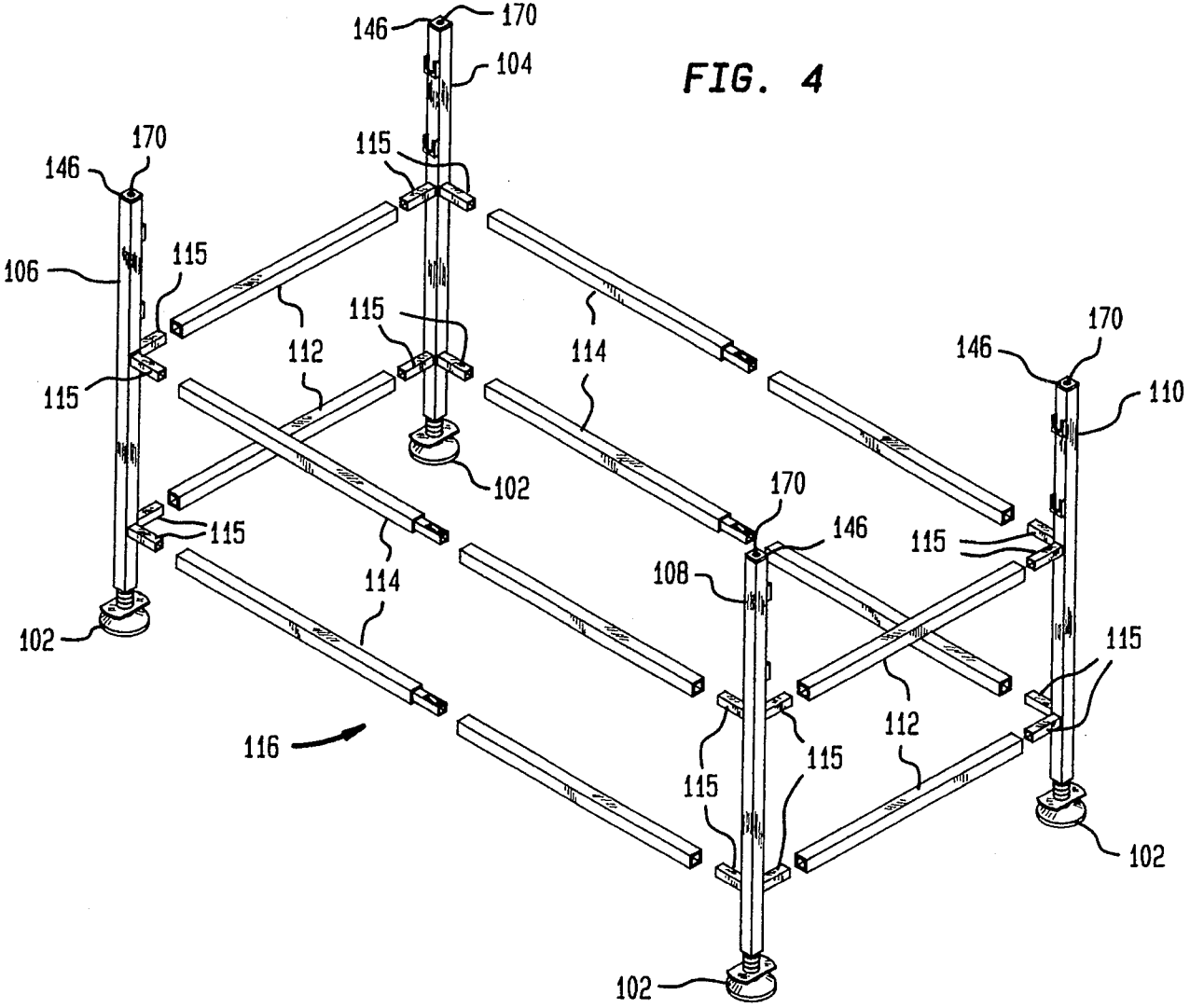
FIG. 4 is an exploded perspective view of the support and corner members which primarily constitute the base of one embodiment of the invention.

The construction of surgical table 100 typically begins with the assembly of base 116. As seen in FIG. 4, base 116 includes adjustable, preferably round foot pads 102, support members 112, left corner members 104, 108, right corner members 106, 110, and extensions 114. It is preferred that these elements be made of a durable and lightweight material. In this embodiment, support members 112, left corner members 104, 108, right corner members 106, 110, and extensions 114 of base 116 are constructed of square aluminum tubing. All aluminum used in table 100 is anodized or chemically treated to help retain the finish and prevent corrosion. One skilled in the art would realize that a multitude of materials may be equally acceptable for use in the construction of the table members and other elements of base 116 and that a multitude of base configurations are possible. In addition, the dimensions and geometrical configurations (e.g. square, cylindrical) of all of the elements are also variable.

Table 100 is supported by four round foot pads 102, in this particular embodiment, held in place by the weight of the table and a frictional fit. Foot pads 102 may be adjusted to raise or lower a height of the table, to compensate for the slope or elevation of the supporting surface, or to make other adjustments in the position of the table.

Nylon inserts 146 with holes 170 are included to allow accessories to be mounted on the top ends of left corner members 104, 108, right corner members 106, 110 through a smooth, hard surface; there is no metal-to-metal contact and, consequently, no galling at these connections. The other elements of base 116 are joined together with cast aluminum couplings. In this particular embodiment, left corner members 104, 108, right corner members 106, 110 and one end of extensions 114 include male protrusions 115. These protrusions mate with the female ends of support members 112 in a frictional fit. Support members 112 are also secured to extensions 114 by a snap fit activated by tabs 117. It is conceivable that other releasable methods may be used to secure these components, including but not limited to bolting, clamping or other means.

Figure 5:
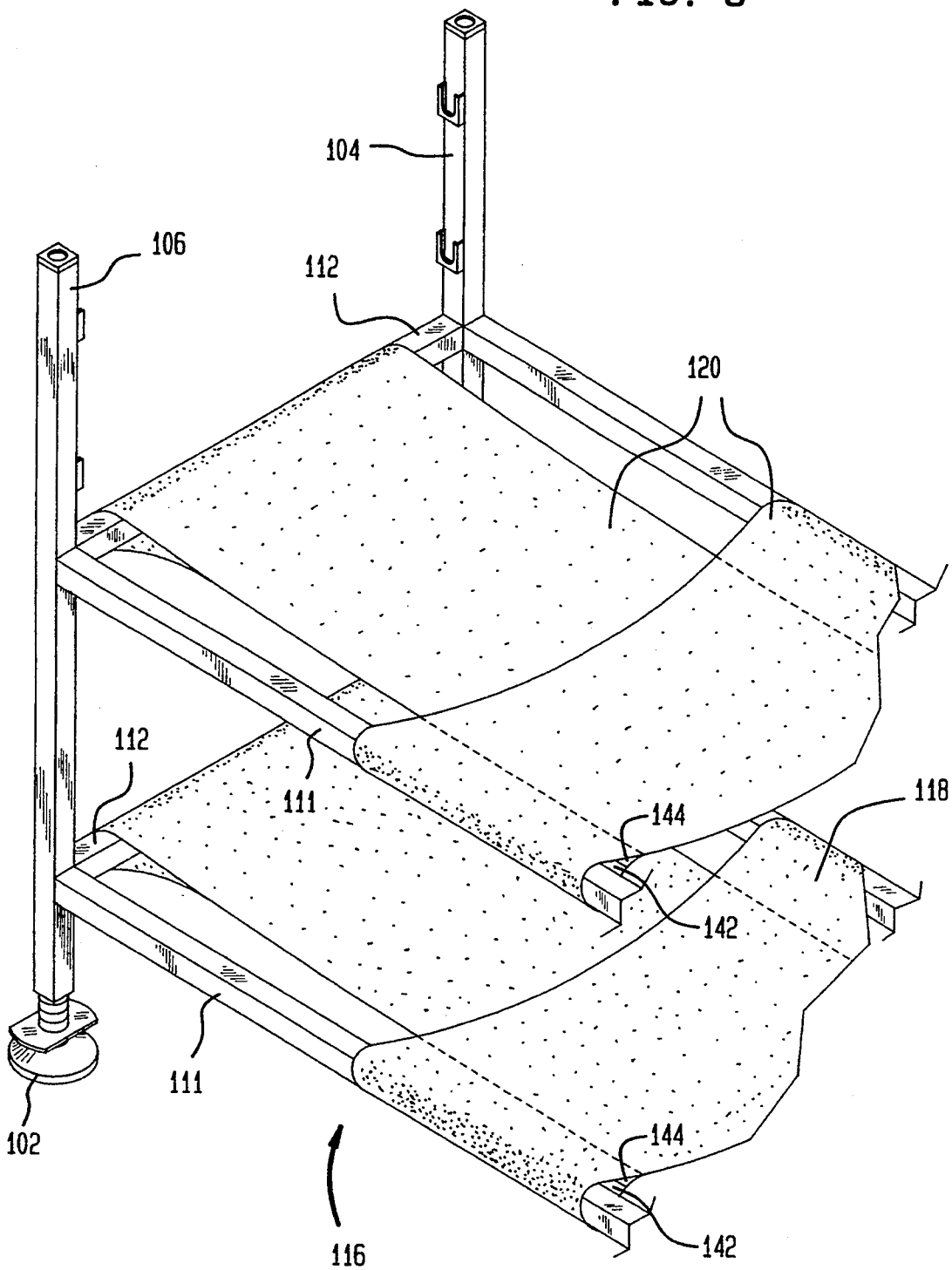
FIG. 5 is a perspective, partial cut away view of components of the base of one embodiment of the present invention as seen in FIG. 4, with the addition of mesh shelves.

Although base 116 may be used alone, it is preferable to include shelving to provide means for housing trays, medical equipment, or other items on the table. As seen in FIG. 5, lower shelf 118 and upper shelf 120 may be included for this purpose. Lower shelf 118 and upper shelf 120 have openings 142 on either edge along their length which allows the assembler to configure lower shelf 118 and upper shelf 120 to hang from base 116 at side members 111. Folds 144, fabricated of a synthetic material that adhere when pressed together, such as VELCRO TM, 144 allow the assembler to wrap the ends of shelves 118 and 120 about support members 112 between left corner member 104 and right corner member 106 and between left corner member 108 and right corner member 110, respectively. Added or alternative support of the shelves is also possible. Although one skilled in the art would realize that lower shelf 118 and upper shelf 120 could be used individually, i.e. one without the other, in this preferred embodiment, both are used with lower shelf 118 positioned approximately 6 to 8 inches from the floor and upper shelf 120 positioned approximately 14 to 16 inches above the lower shelf 118.

In this particular embodiment of the present invention, shelves 118 and 120 are made of polypropylene mesh, thus allowing the shelves to be stored and transported using a minimal amount of space. One skilled in the art would also realize that other materials may be utilized for the shelves. For example, the shelves could be made from wood, aluminum, or plastic. The size of the shelves depends upon, among other things, the desired support space needed, the amount of shelf material available, and the desired configuration of the shelves. For instance, in the present embodiment, the surface area of lower shelf 118 and upper shelf 120, individually, is less than the total area in a horizontal plane in the space defined within left corner members 104, 108 and right corner members 106, 110.

Figure 6:
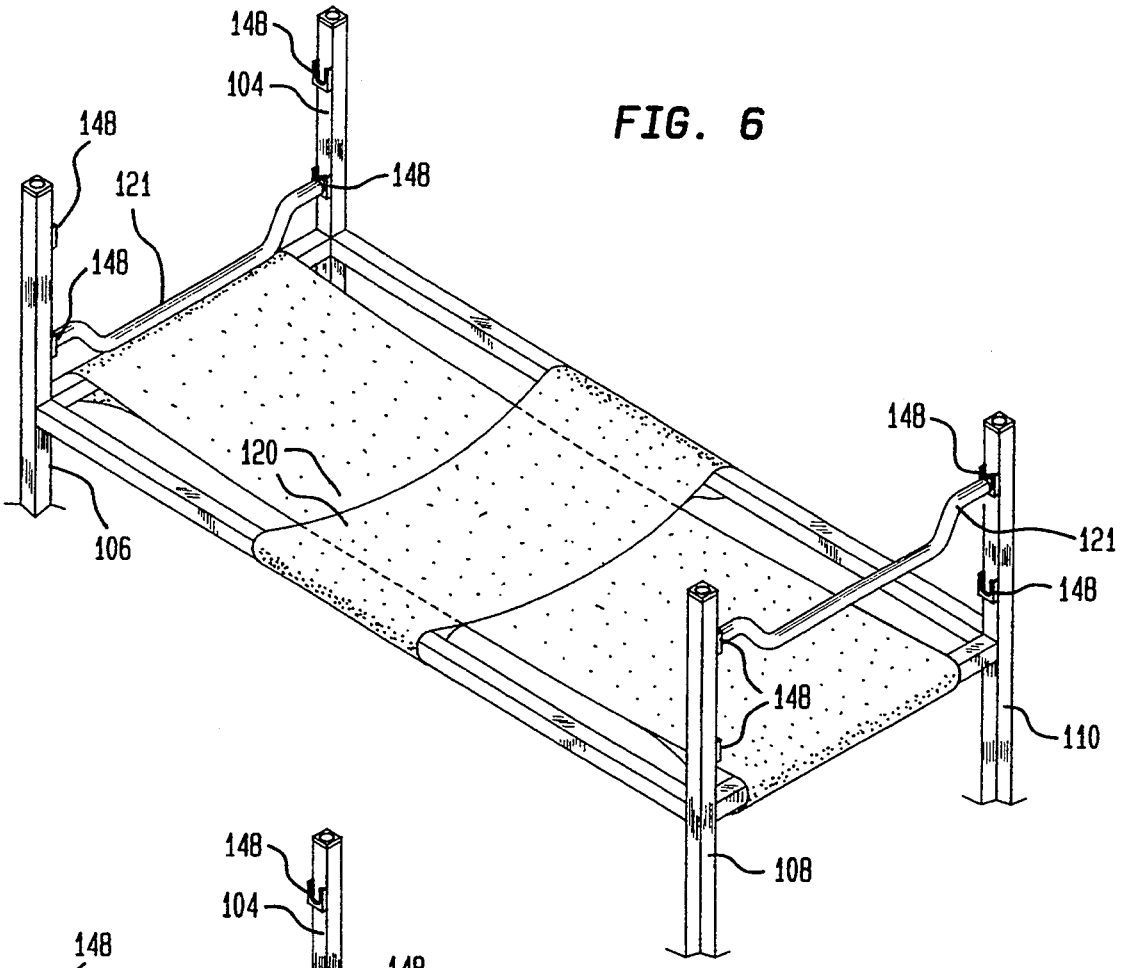
FIG. 6 is a partial exploded perspective view of one embodiment of the present invention, including a partial base, a mesh shelf, and cross members.

The litter is supported on table 100 by cross members 121. As seen in FIG. 6, cross members 121 are located near the top ends of left corner members 104, 108 and right corner members 106, 110. Although FIG. 6 shows the use of two cross members 121, one skilled in the art would realize that the use of one cross member 121 is also conceivable. Where table 100 includes only one cross member 121 to support one end of the litter, other means, e.g., upper support member 112, either between left corner member 104 and right corner member 106 or between left corner member 108 and right corner member 110, may be used to support the opposing end of the litter.

Figure 7:
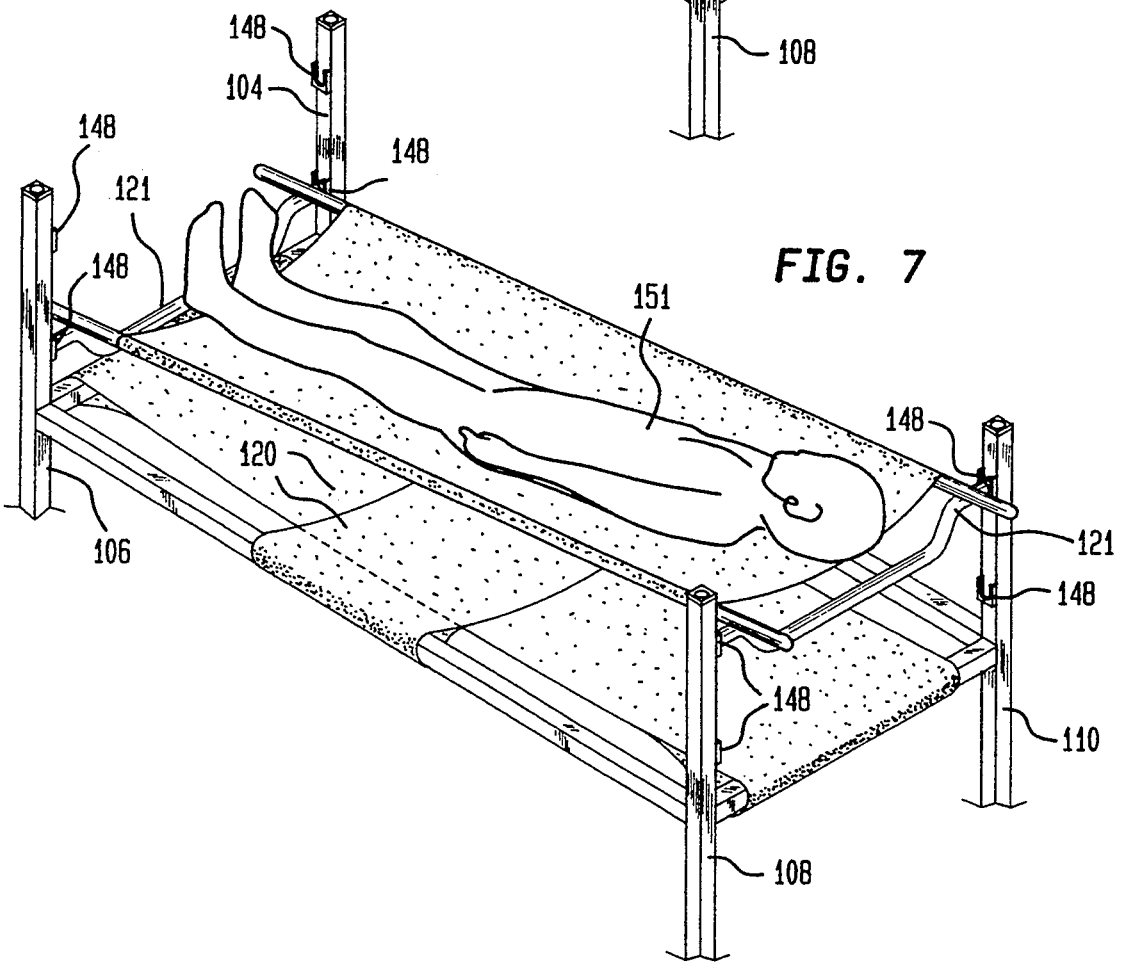
FIG. 7 is a partial perspective view of one embodiment of the present invention, including a partial base, a mesh shelf, cross members, and a litter.
Figure 8:
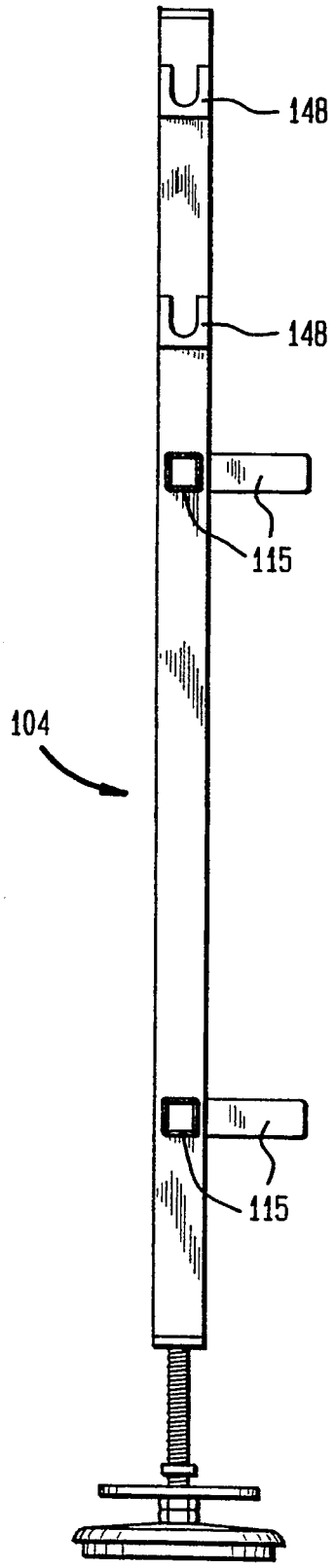
FIG. 8 is a plan side view of a left corner member of one embodiment of the present invention, including cups to support one or more cross members.

Cups 148, affixed to the left corner members 104, 108 and left corner members 106, 110, act as support for cross members 121. As shown in FIG. 7, litter 150 may be positioned on and supported by cross members 121. Each cross member 121 may be positioned lower or higher on left corner members 104, 108 and right corner members 106, 110 at locations corresponding to cups 148. In FIG. 7, cross members 121 are positioned such that the head of patient 151 is raised. In the embodiment shown in FIGS. 6 and 8, one set of cups 148 is approximately 4 inches above side members 111, the level of the upper shelf 120, and the other set of cups 148 are 8.5 inches above the first. The capability for raising or lowering cross members 121, and thus elevating or lowering the head or feet of patient 151, provides the medical personnel with options in the positioning of the patient.

One skilled in the art would realize that means for supporting cross members 121 other than cups 148, e.g. bolts passing through the corner members and into the ends of the cross members, are conceivable. It is also conceivable that the height of the litter above the floor may be changed, while keeping the litter substantially parallel to the floor, by moving both cross members 121 simultaneously from the lower cups 148 to higher cups 148, or visa versa. One skilled in the art would also realize that the floor may not always be flat, i.e. at an angle of zero degrees. The patient, however, may be positioned at zero degrees, nevertheless, by adjusting the position of cross members 121, foot pads 102, or making other modifications (it is often not crucial for the patient to rest at exactly zero degrees, therefore, small angles, relative to a "zero degree" (flat) floor, are often acceptable).

Cross members 121 are preferably made of round aluminum bar stock which is bent so that the center 75% is 2.5 to 3.5 inches below the ends. Any comparable material may be used for this purpose, e.g. strong plastic or wood. The differential between the center and ends of cross member 121 allows the patients' shoulders or his or her calves and ankles to be supported by the litter fabric, and not by table 100, at cross members 121. The feet of the patient fit between cross member 121.

The members of base 116, like cross members 121, are interchangeable. For instance, any support member 112, right corner member 106, 110, or left corner member 104, 108 may be exchanged for another in the construction of base 116. Likewise, cross member 121 may be used at either end of table 100. The interchangeable nature of the elements reduces the possibility that the assembler will find himself or herself lacking a needed component. This interchangeable characteristic also allows the assembler to cannibalize other surgical tables or to stock and use spare parts.

Figure 9:
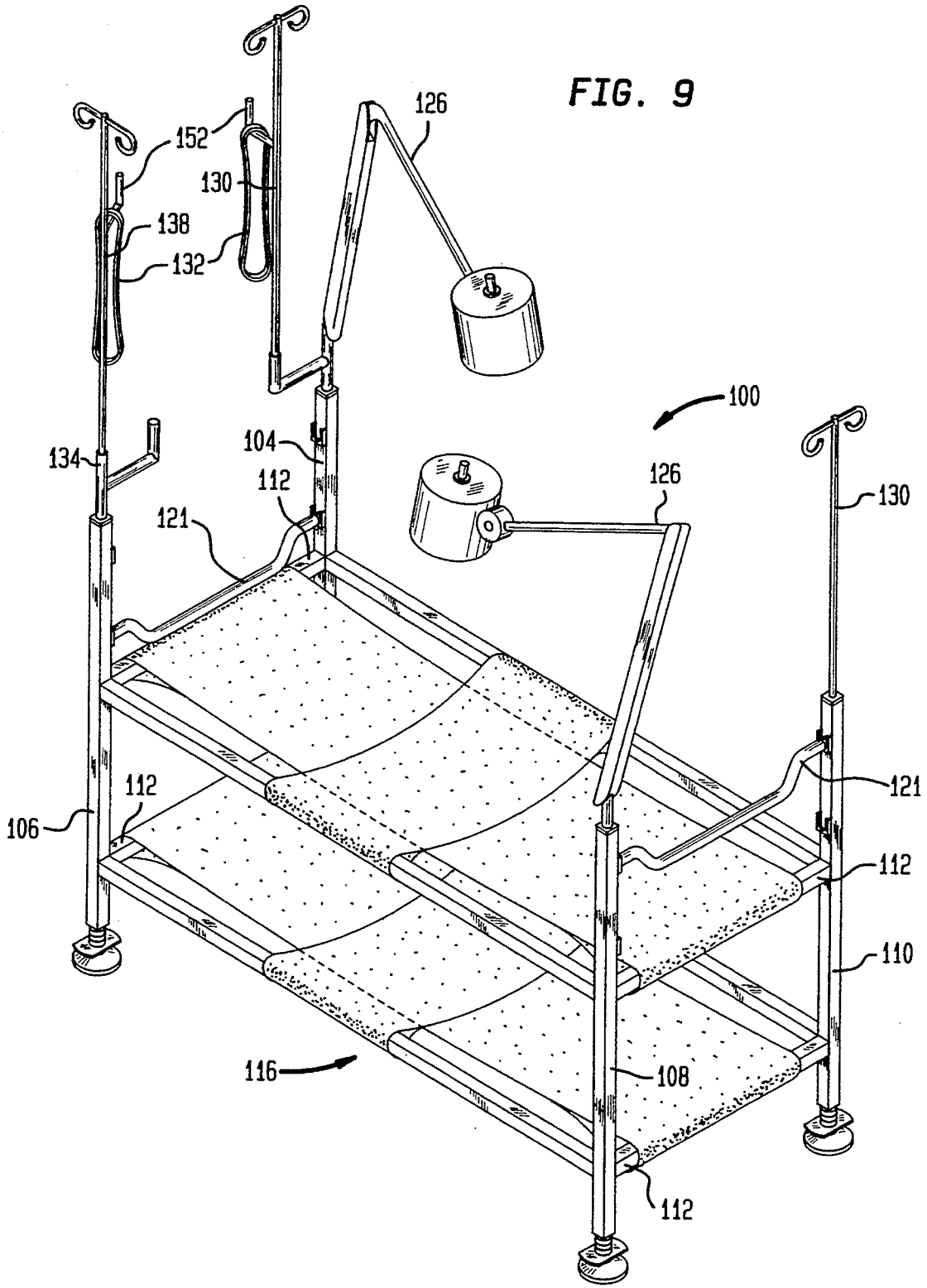
FIG. 9 is a perspective view of one embodiment of the present invention, with the addition of IV poles and lamps.

The medical personnel may add other components or attachments to table 100. For example, as seen in FIG. 9, IV poles 130 may be attached to the top ends of left corner members 104, 108 and right corner members 106, 110. Poles 130 may include hooks 152 to attach such items as stirrup straps 132. Table 100 may also include a mounted light source. For instance, the embodiment of the present invention in FIG. 9 includes two lamp assemblies 126 attached to the top ends of left corner member 104 and right corner member 106. Lamp assemblies 126 may be, for example, two halogen lamps operated on 110 VAC power. Transformers may be built into the arm of lamp assemblies 126 to step down the 110 VAC to 12 VAC. The use of 12 VAC prolongs the bulb life of lamp assemblies 126 while maintaining the output illumination.

Figure 10:
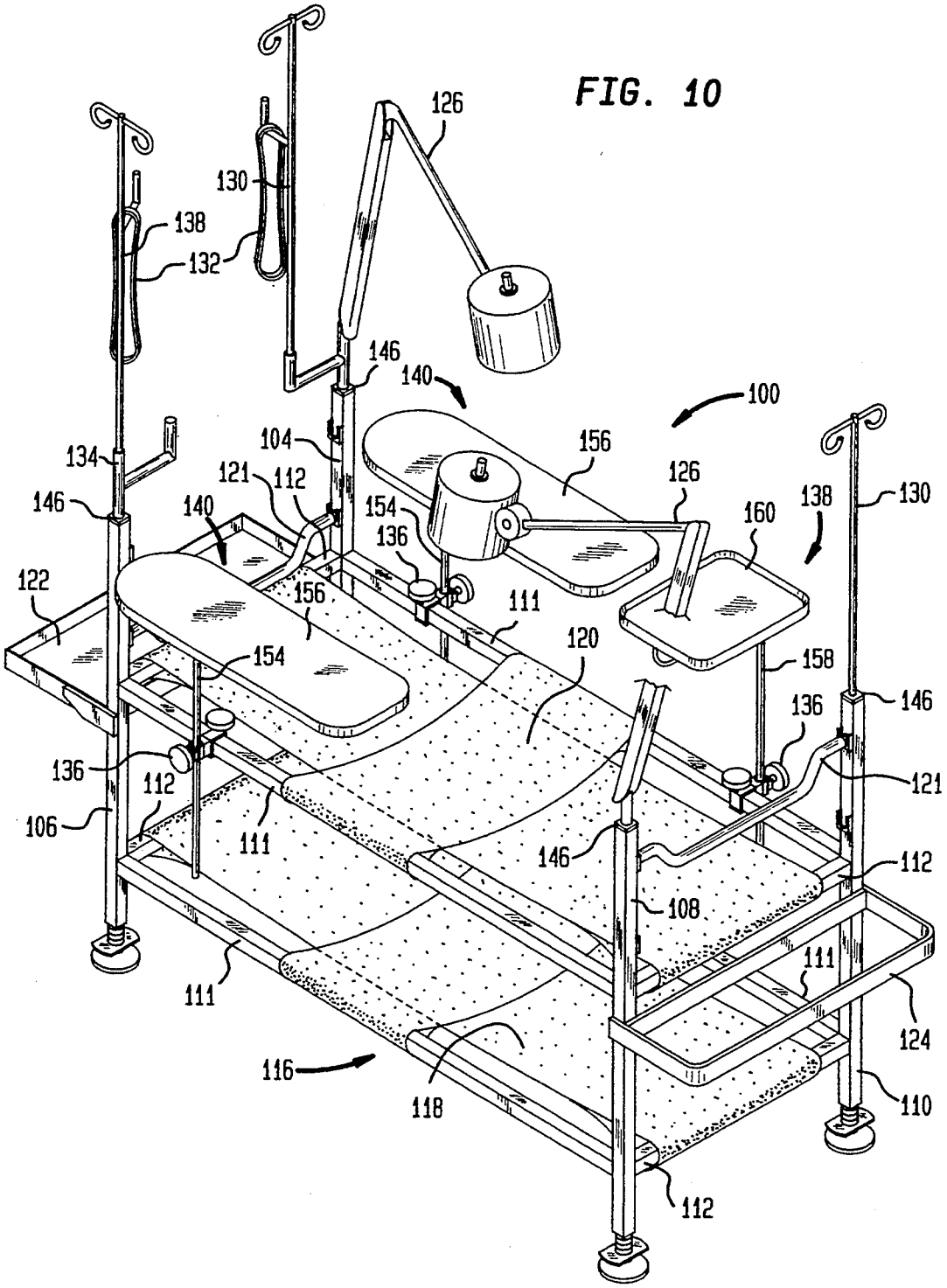
FIG. 10 is a perspective view of one embodiment of the present invention with the addition of tray and arm assemblies.

Other optional equipment includes arm assembly 140, as seen in FIG. 10. Arm assembly 140 includes arm post 154 and arm board 156. Tray stand assembly 138, which includes tray post 158 and tray 160, may also be used. In this particular embodiment, each of these accessories is attached to side members 111 by clamp assemblies 136. The use of clamp assemblies 136 and nylon inserts 140, on the top ends of left corner members 104, 108 and right corner members 106, 110, to mount accessories on table 100 provides the assembler with the capability of mounting any number of accessories in numerous locations and to change their positions. The assembler can therefore change freely between left and right-handed operations.

Figure 11:
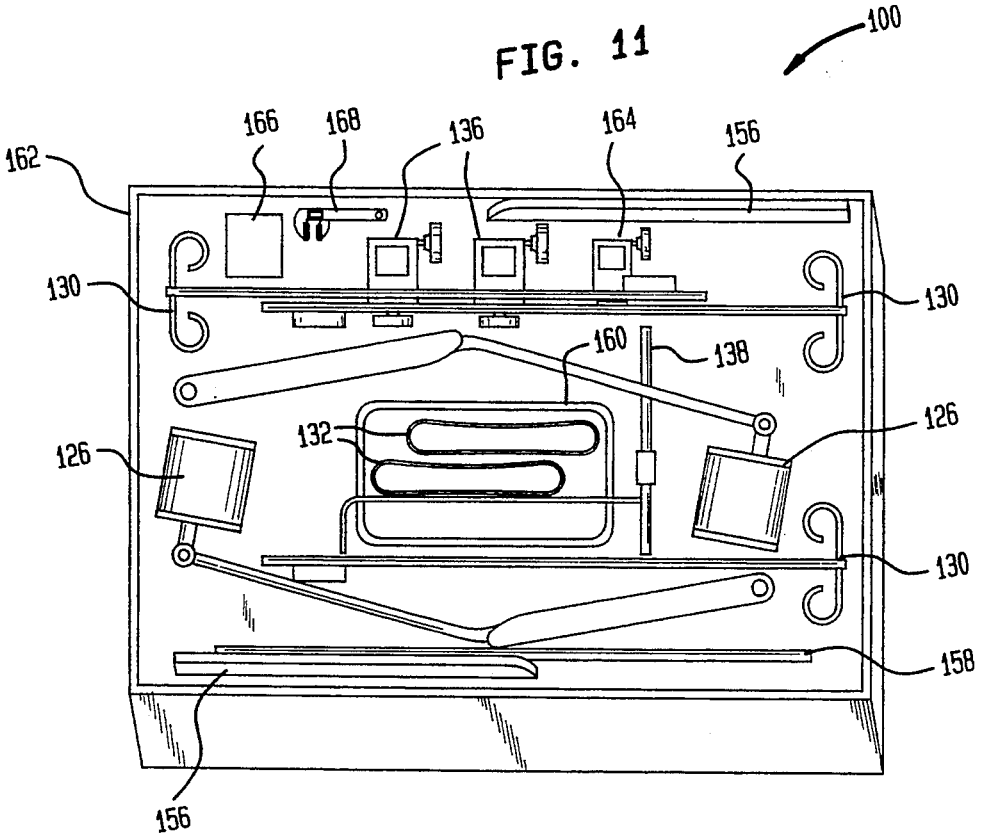
FIG. 11 is a top perspective view of the bottom level of a hard case housing the components of one embodiment of the invention.
Figure 12:
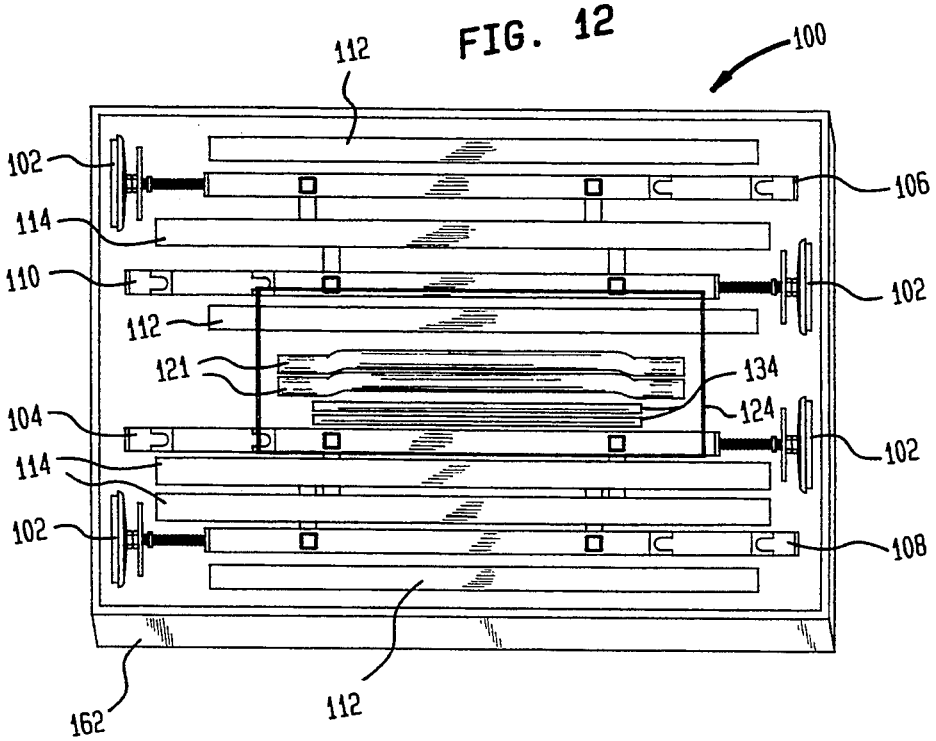
FIG. 12 is a top perspective view of the middle level of the hard case seen in FIG. 10.
Figure 13:
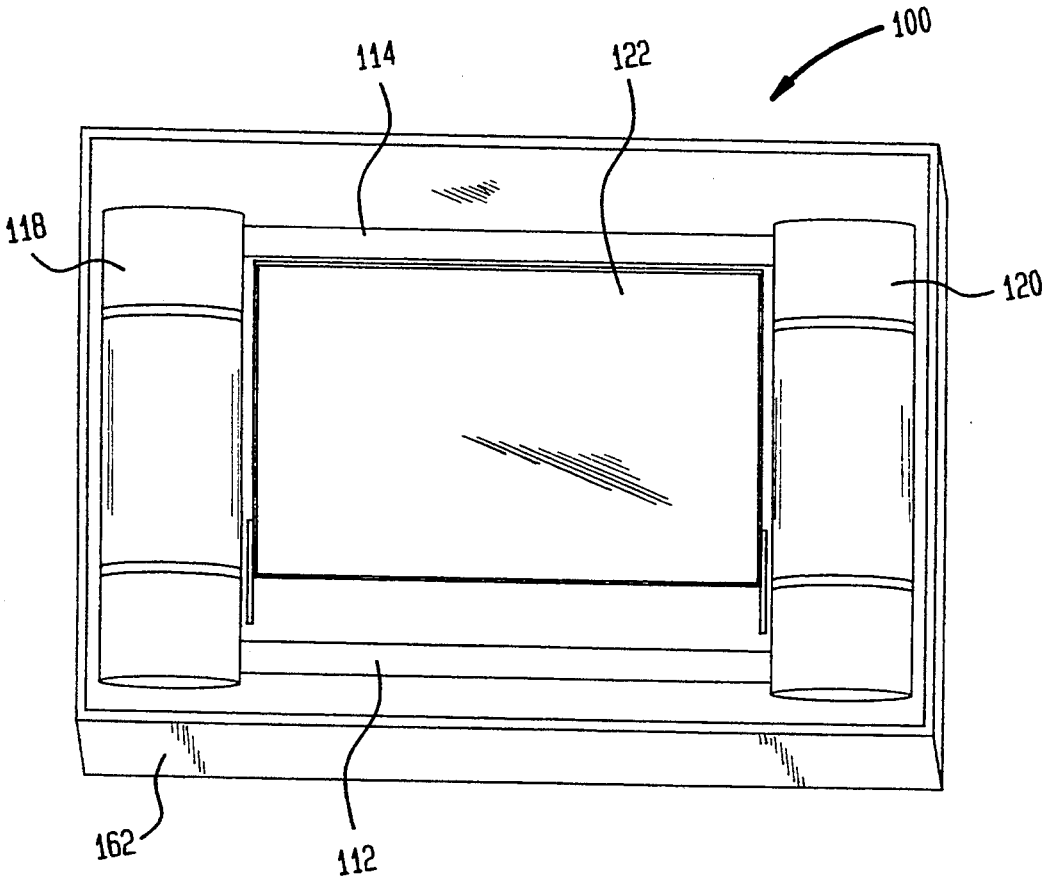
FIG. 13 is a top perspective top view of the top level of the hard case seen in FIG. 10.

All the elements and accessories of table 100 may be disassembled and packaged, for example, in hard case 162 measuring 22½ inches×40 inches×13 inches, as seen in FIGS. 11, 12, and 13. The arrangement of the components in FIGS. 11, 12, and 13 are only an example of a packing scheme. As shown in FIG. 11, the bottom level of the hard case 162 could house items such as clamp assemblies 136, tray clamp assembly 164, arm boards 156, IV poles i 30, tray post 158, tray 160, tray stand assembly 138, straps 132, lamp assemblies 126, bulbs 166, and wrench 168. Bulbs 166 may be used as replacements for lamp assemblies 126. Wrench 168 may be used to tighten, for example, clamp assemblies 136 on side members 111. As seen in FIG. 12, the assembler may store support posts 134, left corner members 104, 108 and right corner members 106, 110 with foot pads 102, cross members 121, support members 112, arm assembly 140, guide weldment 170, and bag frame 124 in the middle level. FIG. 13 shows the top level in hard case 162, which includes lower shelf 118 (rolled) and upper shelf 120 (rolled), the extensions 114, the remaining support member 112, and tray assembly 122. Packaged in this manner, table 100 is easy to store and can withstand harsh means of transport.

The number of elements needed to construct the table is minimized by its structure and the materials used. The elements can be assembled, disassembled, and packaged for transport in a relatively short period of time (e.g. 7–10 minutes). The durability, mobility, and lightweight structure of the components allow the table, for example, to be used in the most adverse of environments to be transported over the most rugged terrains and under the most adverse circumstances, to be airdropped from an airplane or helicopter, and to be used in military field operations and emergency situations.

Although illustrative preferred embodiments have thus been described herein in detail, it should be noted and will be appreciated by those skilled in the art that numerous variations may be made within the scope of this invention without departing from the principle of the invention and without sacrificing its chief advantages. The terms and expressions have been used as terms of description and not terms of limitation. There is no intention to use the terms or expressions to exclude any equivalents of features shown and described or portions thereof and the invention should be defined in accordance with the claims which follow.

What is claimed:

1. A portable surgical table capable of rapid assembly and disassembly comprising:

a base capable of supporting a military litter above ground level;

at least one movable cross member attached to said base which may be moved from a first position on said base to a second position on said base, wherein said military litter rests at a first angle relative to said ground level when placed upon said base and said movable cross member with said movable cross member attached at said first position and said military litter rests at a second angle relative to said ground level when placed upon said base and said movable cross member with said movable cross member attached to said base at said second position;

at least one adjustable foot pad, supporting said base, for compensating a slope of a supporting surface thereof; and a hard casing for packaging the table when said base and said cross member are disassembled for transport and airdrop into an adverse environment.

2. A surgical table, according to claim 1, wherein said first angle with said cross member in said first position corresponds to said litter resting substantially parallel to ground level.

3. A surgical table, according to claim 1, wherein said second angle with said cross member in said second position corresponds to said litter resting parallel to ground level.

4. A surgical table, according to claim 1, further comprising at least one arm board.

5. A surgical table, according to claim 1, further comprising at least one trash holder.

6. A surgical table, according to claim 1, wherein said base comprises connected horizontal and vertical members.

7. A surgical table according to claim 6, further comprising foot pads on the ends of said vertical members.

8. A surgical table according to claim 6, wherein said horizontal and vertical members are tubular.

9. A surgical table according to claim 6, wherein aluminum is used for said horizontal and vertical members.

10. A surgical table according to claim 9, wherein said horizontal and vertical members are anodized.

11. A surgical table according to claim 1, further comprising at least one member extending upward from said base upon which medical equipment may be attached.

12. A surgical table according to claim 1, further comprising at least one light source attached to said table.

13. A surgical table, according to claim 12, wherein said light source comprises at least one halogen lamp.

14. A surgical table, according to claim 1, further comprising at least one shelf attached to said base.

15. A surgical table, according to claim 1, wherein a first movable cross member is proximate to a first end of said base and further comprising a second moveable cross member proximate to a second end of said base.

16. A surgical table, according to claim 15, wherein said first and second cross members are moveable from a first position relative to each other in which they are attached to said base and in a plane at a first angle to said ground level, to at least one second position relative to each other in which they are attached to said base and in a plane at a second angle to said ground level.

17. A surgical table, according to claim 1, further comprising at least one tray attached to said table.

18. A surgical table comprising:

a base capable of supporting a military litter above ground level;

at least one movable cross member attached to said base which may be moved from a first position on said base to a second position on said base, wherein said military litter rests at a first angle relative to said ground level when placed upon said base and said movable cross member with said movable cross member attached at said first position and said military litter rests at a second angle relative to said ground level when placed upon said base and said movable cross member with said movable cross member attached to said base at said second position; and an auxiliary component attached to said base selected from the group of arm board, shelf, trash holder, light source, tray, and stirrup strap.

19. The surgical table according to claim 18, further comprising at least one adjustable foot pad, supporting said base, for compensating a slope of a supporting surface thereof, and a hard casing for packaging the table when said base, said auxiliary component, and said cross member are disassembled for transport and airdrop into an adverse environment.

20. A surgical table comprising:

a base capable of supporting a military litter above ground level;

at least one movable cross member attached to said base which may be moved from a first position on said base to a second position on said base, wherein said military litter rests at a first angle relative to said ground level when placed upon said base and said movable cross member with said movable cross member attached at said first position and said military litter rests at a second angle relative to said ground level when placed upon said base and said movable cross member with said movable cross member attached to said base at said second position; and a medical tray attached to said base.

21. The surgical table according to claim 20, further comprising an arm board attached to said base.

22. The surgical table according to claim 21, further comprising a light source attached to said base.

23. The surgical table according to claim 22, further comprising a stirrup strap attached to said base.

24. The surgical table according to claim 20, further comprising at least one adjustable foot pad, supporting said base, for compensating a slope of a supporting surface thereof and a hard casing for packaging the table when said base, said medical tray, and said cross member are disassembled for transport and airdrop into an adverse environment.

* * * * *